US012768132B2

(12) United States Patent
Krone

(10) Patent No.: US 12,768,132 B2
(45) Date of Patent: Oct. 20, 2026

(54) CONTROLLER, OPERATOR ASSISTANCE SYSTEM, AND METHOD OF ASSISTING OPERATOR OF WORK MACHINE

(71) Applicant: Caterpillar Inc., Peoria, IL (US)

(72) Inventor: Bradley Krone, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 840 days.

(21) Appl. No.: 17/661,942

(22) Filed: May 4, 2022

(65) Prior Publication Data

US 2023/0358016 A1 Nov. 9, 2023

(51) Int. Cl.

*E02F 3/84* (2006.01)
*E02F 5/32* (2006.01)
*E02F 9/26* (2006.01)

(52) U.S. Cl.

CPC ..... *E02F 3/847* (2013.01); *E02F 5/32* (2013.01); *E02F 9/262* (2013.01); *E02F 9/265* (2013.01)

(58) Field of Classification Search

CPC ... E02F 3/847; E02F 5/32; E02F 9/262; E02F 9/265; E02F 3/844; E02F 3/7604; E02F 9/261

See application file for complete search history.

(56) References Cited

U.S. PATENT DOCUMENTS 7,814,670 B2 10/2010 Katayama et al.
8,788,157 B2 7/2014 Shintani et al.
9,540,786 B2 1/2017 Ogawa
10,519,631 B2 12/2019 Forcash et al.
2013/0116894 A1* 5/2013 Perez-Iturbe ..... A01D 45/10 701/50
2014/0188333 A1* 7/2014 Friend ..... E02F 9/261 701/34.4
2014/0271074 A1* 9/2014 Ogawa ..... E02F 9/264 414/687
2016/0193920 A1* 7/2016 Tsubone ..... B60K 35/22 701/36
2018/0245316 A1* 8/2018 Forcash ..... E02F 1/00
2019/0330825 A1 10/2019 Tanimoto et al.
2020/0375106 A1* 12/2020 Seiders, Jr. ..... A01D 41/145
2021/0131075 A1 5/2021 Kumakura et al.
2021/0404151 A1* 12/2021 Nakazawa ..... B60R 1/27

* cited by examiner

*Primary Examiner* — King Y Poon
*Assistant Examiner* — Vincent Alexander Providence

(57) ABSTRACT

A controller includes one or more memories and one or more processors. The one or more processors are configured to receive an input image. The input image contains a first pictorial view that includes a work implement of a work machine. The one or more processors are also configured to generate an output image containing a second pictorial view and an indication element superimposed on the second pictorial view. The second pictorial view is at least in part derived from the first pictorial view and includes the work implement. The indication element includes at least one reference line. An alignment of one or more portions of the work implement with the at least one reference line indicates that the one or more portions of the work implement are positioned at a desired height from a ground surface.

20 Claims, 7 Drawing Sheets

CONTROLLER, OPERATOR ASSISTANCE SYSTEM, AND METHOD OF ASSISTING OPERATOR OF WORK MACHINE

TECHNICAL FIELD

The present disclosure relates to a controller and an operator assistance system associated with a work machine. The present disclosure also relates to a method of assisting an operator of the work machine.

BACKGROUND

A work machine, such as a track type tractor, may be used to perform various types of work operations, such as, excavation, digging, moving, placement, compacting, levelling, dozing, grading, and hauling of materials. Such work machines may include one or more work implements for performing the work operations. Typically, the work implement may be lowered or raised by an operator seated within an operator cabin. The operator cabin may include one or more control devices to control the work implement of the work machine.

In some cases, the operator seated within the operator cabin may not have a clear visual access to the work implement. For example, due to a size of the work machine or a positioning of the work implement, the operator may not be able to view the work implement from the operator cabin. In some situations, it may be challenging for the operator to raise or lower the work implement to an optimum height because of limited visual access. In such examples, the work implement may be unintentionally lowered to a non-optimum height which may affect a productivity of the work operations. Further, in some cases, the work implement may be unintentionally lowered into a ground, which may damage one or more components of the work implement, which is not desirable.

U.S. Publication Application Number 2019/330825 describes an image display system for a work machine including working equipment having a working tool and a turning body to which the working equipment is attached. The image display system includes a position detector detecting at least one of an attitude and a position of the working equipment, a distance detector obtaining information on a distance from the work machine to a work target, and a processing device that generates, by using information on a position of the working tool obtained by the position detector and information on a position of the work target obtained from the information on the distance obtained by the distance detector. A first image is displayed on the user interface. The first image includes a portion corresponding to a part of the working tool and extending along a turning direction of the turning body, on the work target opposed to the working tool.

SUMMARY OF THE DISCLOSURE

In an aspect of the present disclosure, a controller is provided. The controller includes one or more memories. The controller also includes one or more processors. The one or more processors are configured to receive an input image. The input image contains a first pictorial view that includes a work implement of a work machine. The one or more processors are also configured to generate an output image containing a second pictorial view and an indication element superimposed on the second pictorial view. The second pictorial view is at least in part derived from the first pictorial view and includes the work implement. The indication element includes at least one reference line. An alignment of one or more portions of the work implement with the at least one reference line indicates that the one or more portions of the work implement are positioned at a desired height from a ground surface.

In another aspect of the present disclosure, an operator assistance system associated with a work machine is provided. The operator assistance system includes an imaging device mounted on the work machine and facing a work implement of the work machine. The imaging device is configured to capture an input image containing a first pictorial view that includes the work implement. The operator assistance system also includes a controller communicably coupled with the imaging device. The controller includes one or more processors. The one or more processors are configured to receive the input image from the imaging device. The one or more processors are also configured to generate an output image containing a second pictorial view and an indication element superimposed on the second pictorial view. The second pictorial view is at least in part derived from the first pictorial view and includes the work implement. The indication element includes at least one reference line. An alignment of one or more portions of the work implement with the at least one reference line indicates that the one or more portions of the work implement are positioned at a desired height from a ground surface. The operator assistance system further includes a user interface configured to receive the output image from the one or more processors. The user interface is configured to display the output image thereon to assist the operator in positioning the one or more portions of the work implement at the desired height.

In yet another aspect of the present disclosure, a method of assisting an operator of a work machine is provided. The method includes capturing, by an imaging device mounted on the work machine and facing a work implement of the work machine, an input image containing a first pictorial view that includes the work implement. The method also includes receiving, by a controller communicably coupled with the imaging device, the input image from the imaging device. The method further includes generating, by the controller, an output image containing a second pictorial view and an indication element superimposed on the second pictorial view. The second pictorial view is at least in part derived from the first pictorial view and includes the work implement. The indication element includes at least one reference line. An alignment of one or more portions of the work implement with the at least one reference line indicates that the one or more portions of the work implement are positioned at a desired height from a ground surface. The method includes displaying the output image on a user interface to assist the operator in positioning the one or more portions of the work implement at the desired height. The user interface is configured to receive the output image from the controller.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
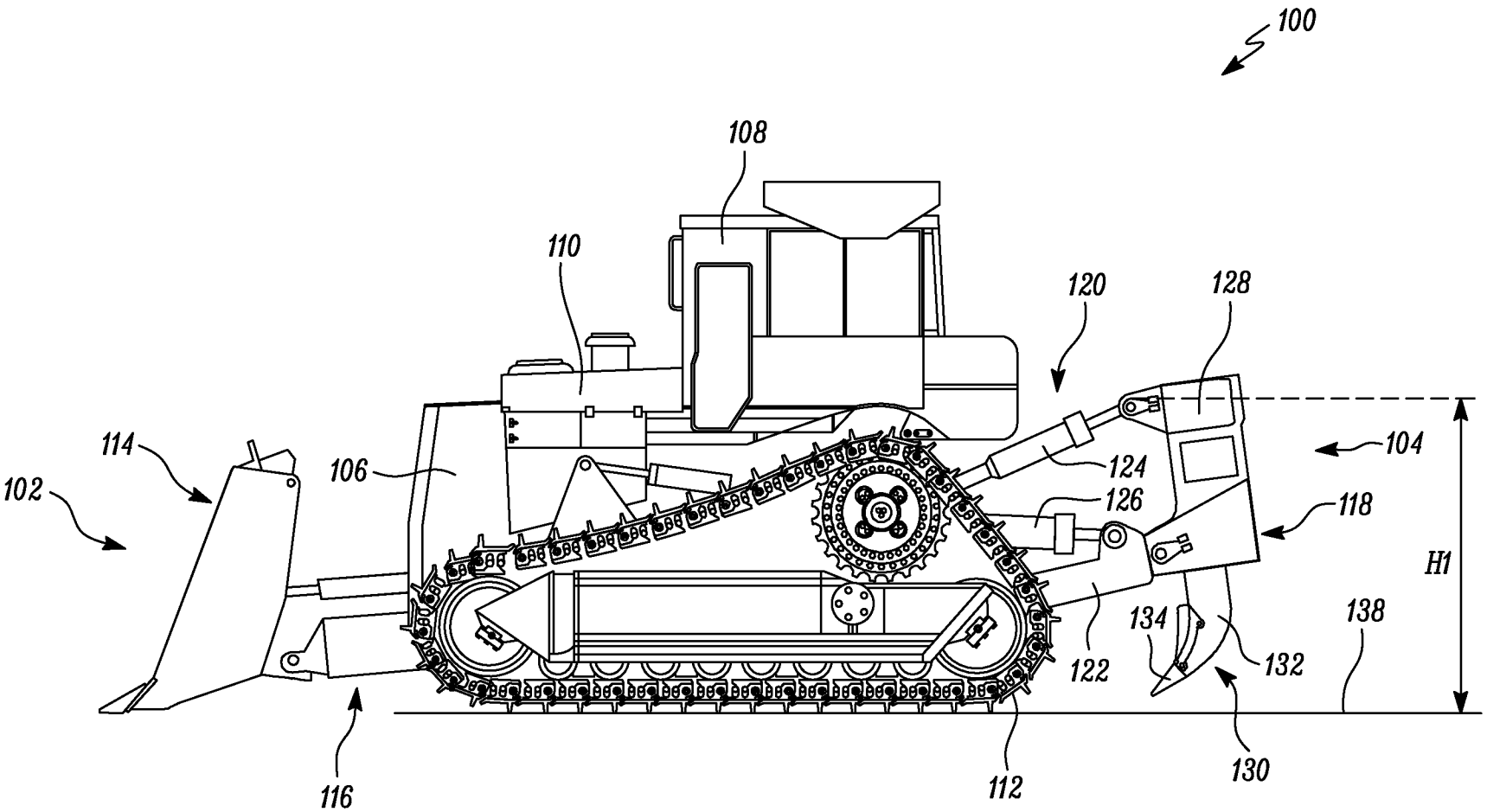
FIG. 1 is a schematic side view of a work machine wherein a work implement of the work machine is disengaged from a ground surface, according to an embodiment of the present disclosure.

Referring to FIG. 1, a schematic side view of an exemplary work machine 100 is illustrated. In the illustrated embodiment of FIG. 1, the work machine 100 is a track type tractor. In alternate embodiments, the work machine 100 may include a grader, a loader, a dozer, a compactor, an excavator, a shovel, and the like, without any limitations. The work machine 100 may perform one or more work operations associated with an industry, such as, mining, construction, farming, transportation, or any other industry known in the art.

The work machine 100 defines a front end 102 and a rear end 104. The work machine 100 includes a frame 106 that supports various machine components thereon. The work machine 100 also includes an operator cabin 108. The operator cabin 108 is mounted on the frame 106. An operator of the work machine 100 may be seated within the operator cabin 108 to perform one or more work operations. Moreover, the work machine 100 may include other components (not shown), such as, a transmission system, a drive train, numerous hydraulic or pneumatic pumps, and the like, that may be supported by the frame 106 of the work machine 100.

The work machine 100 further includes a power source (not shown) that generates power. The power source may be an engine, such as, an internal combustion engine (for e.g., a compression ignition diesel engine), a gas turbine engine, and the like. The power source is mounted on the frame 106. The power source is enclosed within an enclosure 110. The work machine 100 also includes a pair of ground engaging members 112. Each ground engaging member 112 is embodied as a track herein. Alternatively, the work machine 100 may include wheels or drums instead of the tracks.

The work machine 100 also includes a first work implement 114 disposed proximate to the front end 102. The first work implement 114 may be interchangeably referred to as the work implement 114. The work implement 114 is operably connected to the frame 106 by a linkage assembly 116 associated with the work implement 114. The work implement 114 may be used for material handling, material removal, and/or material transportation. In the illustrated embodiment of FIG. 1, the work implement 114 is a blade. Alternatively, the work implement 114 may include a bucket, or any other type of work implement, without any limitations.

Further, the work machine 100 includes a second work implement 118 disposed proximate to the rear end 104. The second work implement 118 may be interchangeably referred to as the work implement 118. The work implement 118 is operably connected to the frame 106. The work implement 118 also includes a linkage assembly 120 that operably connects the work implement 118 with the frame 106. The linkage assembly 120 may facilitate a movement of the work implement 118 relative to the frame 106. The linkage assembly 120 includes a pair of brackets 122 (only one of which is illustrated herein) that couples the frame 106 and the work implement 118. The linkage assembly 120 also includes a pair of first actuators 124 (only one of which is illustrated herein) and a pair of second actuators 126 (only one of which is illustrated herein). In some examples, the work implement 118 may be used to break hard materials, such as, rocks, ice, and the like.

In the illustrated embodiment of FIG. 1, the work implement 118 is a ripper. Alternatively, the work implement 118 may include any other type of work implement, such as a blade, a bucket, or a scarifier, without any limitations. In the illustrated embodiment of FIG. 1, the work implement 118 includes a carriage 128 coupled to the brackets 122, the pair of first actuators 124, and the pair of second actuators 126. The work implement 118 also includes a ground engaging element 130 coupled to the carriage 128. The ground engaging element 130 includes a shank 132 and a tooth 134 coupled to the shank 132. In some examples, the work implement 118 may be controlled by the operator based on an input provided to an operating device 136 (see FIG. 3) associated with the work implement 118. The operating device 136 may be positioned within the operator cabin 108. The operating device 136 may embody a joystick, for example.

The work implement 118 is illustrated in a raised position in FIG. 1. In other words, the work implement 118 is disengaged from a ground surface 138. In some examples, the work implement 118 may be disposed in the raised position when the work machine 100 may be idle or travelling.

Figure 2:
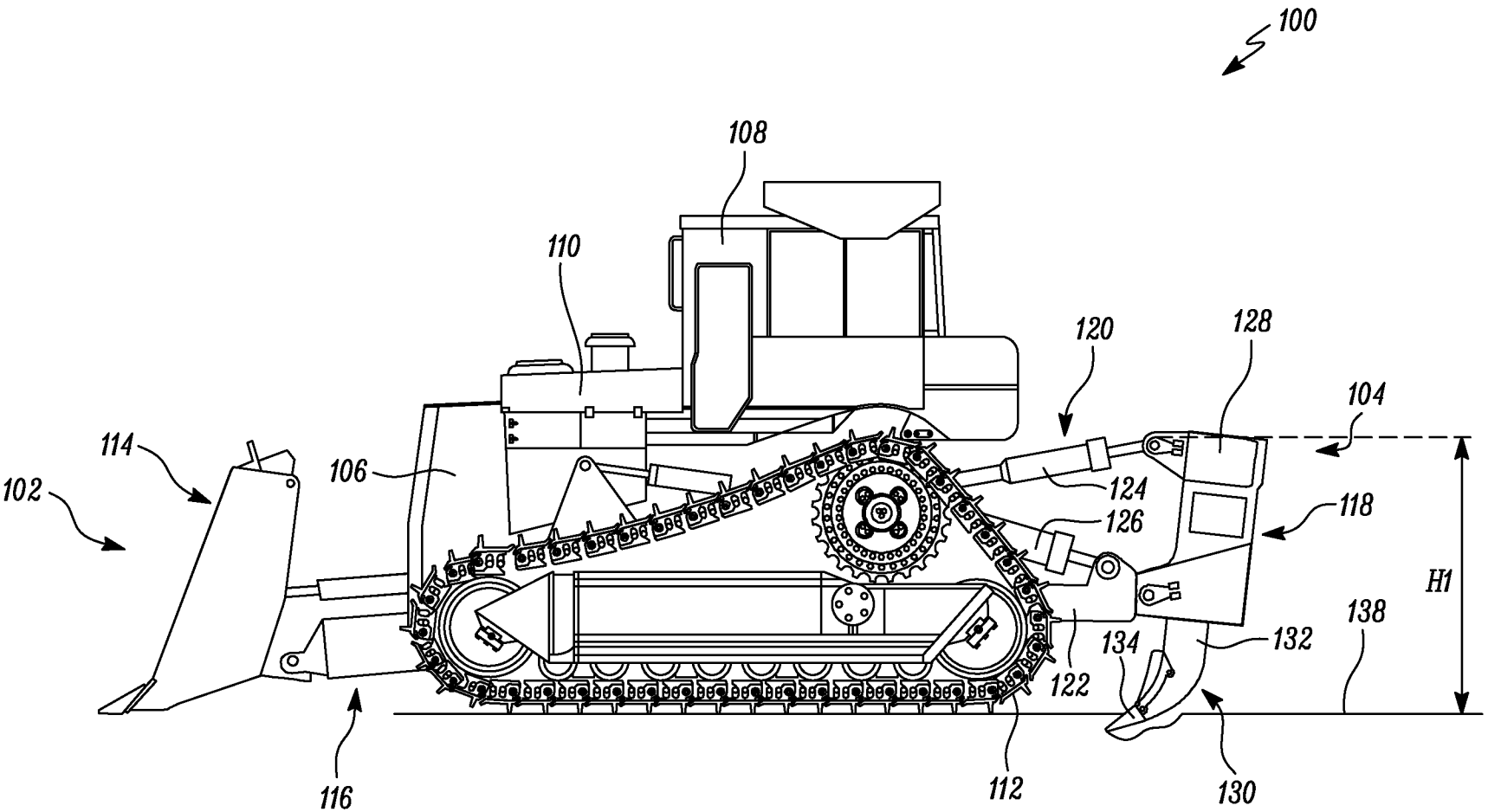
FIG. 2 is a schematic side view of the work machine wherein the work implement of FIG. 1 is engaged with the ground surface.

Referring to FIG. 2, when a work operation, such as a material removal operation, is to be performed, the work implement 118 may be moved to a lowered position. In other words, the work implement 118 may engage with the ground surface 138 during the work operation. In such examples, the operator of the work machine 100 may have to gauge an amount by which the work implement 118 needs to be lowered so that the work implement 118 is positioned accurately, as per application requirements. The present disclosure relates to an operator assistance system 200 (shown in FIG. 3) that assists the operator in positioning the work implement 118 accurately during various work operations. The operator assistance system 200 will be explained in relation to an adjustment of the position of the work implement 118. However, the operator assistance system 200 may also be used to adjust a position the work implement 114, without any limitations.

Figure 3:
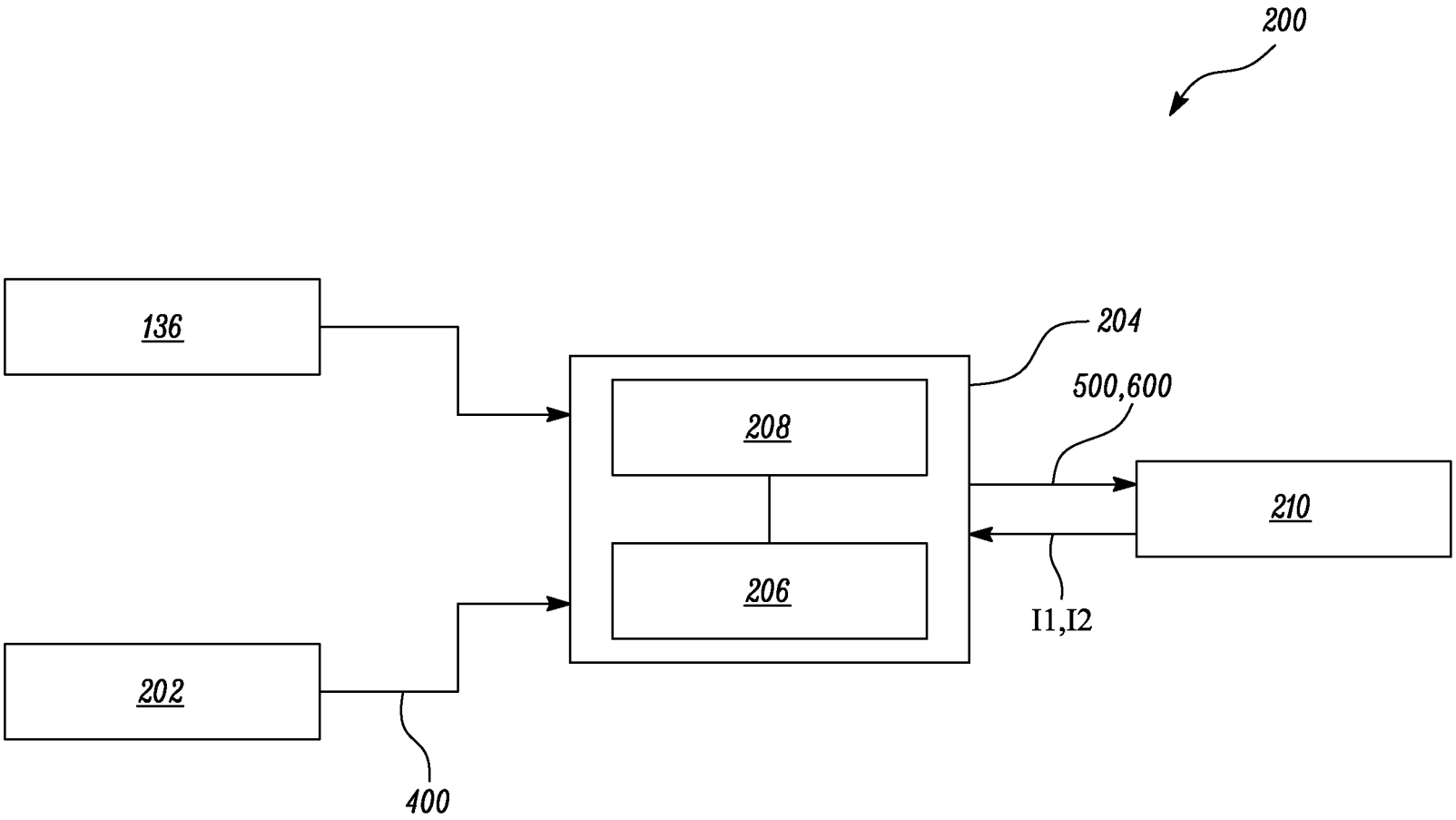
FIG. 3 illustrates a block diagram of an operator assistance system associated with the work machine of FIGS. 1 and 2, according to an embodiment of the present disclosure.

Referring to FIG. 3, a block diagram of the operator assistance system 200 associated with the work machine 100 (see FIG. 1) is illustrated. The operator assistance system 200 includes an imaging device 202 mounted on the work machine 100 and facing the work implement 118 (see FIGS. 1 and 2) of the work machine 100. The imaging device 202 captures an input image 400 (shown in FIG. 4) containing a first pictorial view 402 (shown in FIG. 4) that includes the work implement 118. It should be noted that the term "input image" as used herein may include images or videos, that present a real time view of the work implement 118.

The imaging device 202 is mounted proximate to the rear end 104 (see FIGS. 1 and 2) of the work machine 100. The imaging device 202 may be positioned at a location on the work machine 100, such that the work implement 118 lies in a field of view of the imaging device 202. In an example, the imaging device 202 may be positioned on the operator cabin 108 (see FIGS. 1 and 2) of the work machine 100. In some examples, the imaging device 202 may be adjustable relative to the frame 106 (see FIG. 1) of the work machine 100 to ensure that the work implement 118 lies in the field of view of the imaging device 202. In the illustrated embodiment of FIG. 3, the operator assistance system 200 includes a single imaging device 202. However, it may be contemplated that the operator assistance system 200 may include multiple imaging devices, without any limitations. In some examples, the operator assistance system 200 may include another imaging device that captures an input image of the work implement 114.

The imaging device 202 may include a camera. In an example, the imaging device 202 may include a digital video camera, such as, an ethernet camera. It should be noted that the imaging device 202 may include any other type of imaging device known in the art and the present disclosure is not limited by a type of the imaging device 202.

The operator assistance system 200 also includes a controller 204 communicably coupled with the imaging device 202. The controller 204 includes one or more memories 206. The memories 206 may include, for example, a flash memory, a random-access memory (RAM), and an electrically erasable programmable read-only memory (EEPROM). The memories 206 may store data, such as, algorithms, instructions, and arithmetic operations. The controller 204 may execute various types of digitally stored instructions, such as, a software or an algorithm, retrieved from the memories 206, or a firmware program which may enable the controller 204 to perform a wide variety of operations.

The controller 204 also includes one or more processors 208. The one or more processors 208 may be communicably coupled to the one or more memories 206. The one or more processors 208 may be any device that performs logic operations. It should be noted that the one or more processors 208 may embody a single microprocessor or multiple microprocessors for receiving various input signals. Numerous commercially available microprocessors may be configured to perform the functions of the one or more processors 208. The one or more processors 208 may include a general processor, a central processing unit, an application specific integrated circuit (ASIC), a digital signal processor, a field programmable gate array (FPGA), a digital circuit, an analog circuit, a controller, a microcontroller, any other type of processor, or any combination thereof. The one or more processors 208 may include components that may be operable to execute computer executable instructions or computer codes that may be stored and retrieved from the one or more memories 206. A person of ordinary skill in the art will appreciate that the controller 204 may additionally include other components apart from the processors 208 and the memories 206, and may perform other functions not described herein.

Figure 4:
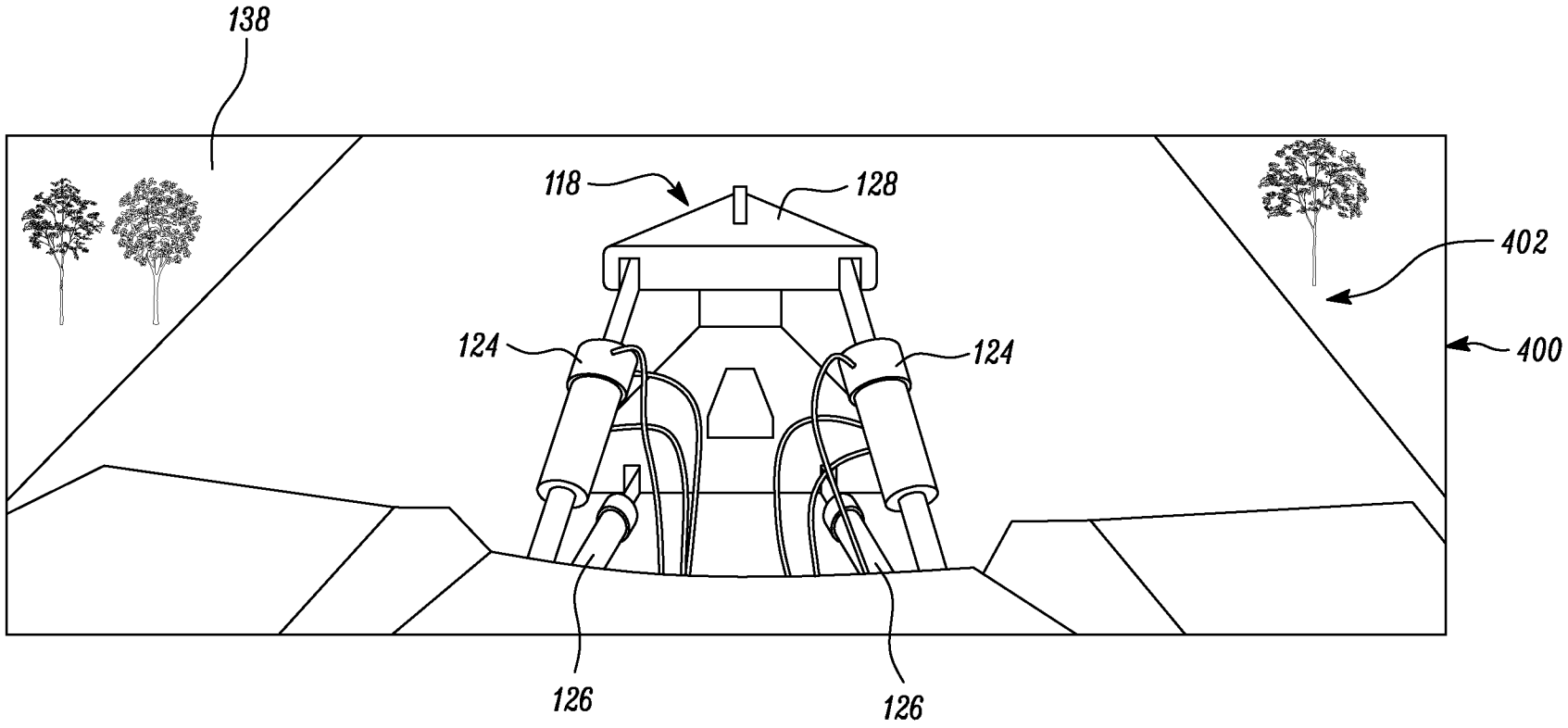
FIG. 4 illustrates an input image generated by an imaging device of the operator assistance system of FIG. 3, according to an embodiment of the present disclosure.

Further, the one or more processors 208 receive the input image 400 (see FIG. 4). More specifically, the processors 208 receive the input image 400 from the imaging device 202. Referring to FIG. 4, the input image 400 generated by the imaging device 202 is illustrated. In the illustrated embodiment of FIG. 4, the input image 400 corresponds to a live feed as captured by the imaging device 202 when the work implement 118 is engaged with the ground surface 138 (as shown in FIG. 2). Alternatively, the input image 400 may corresponds to a live feed as captured by the imaging device 202 when the work implement 118 is disengaged from the ground surface 138 (as shown in FIG. 1).

Further, the first pictorial view 402 includes various portions of the work implement 118. In the illustrated embodiment of FIG. 4, the first pictorial view 402 includes the pair of first actuators 124, the second actuators 126, and the carriage 128 of the work implement 118. However, in other examples, the first pictorial view 402 may also include the ground engaging element 130, the pair of second actuators 126, or any other portion of the work implement 118.

Figure 5:
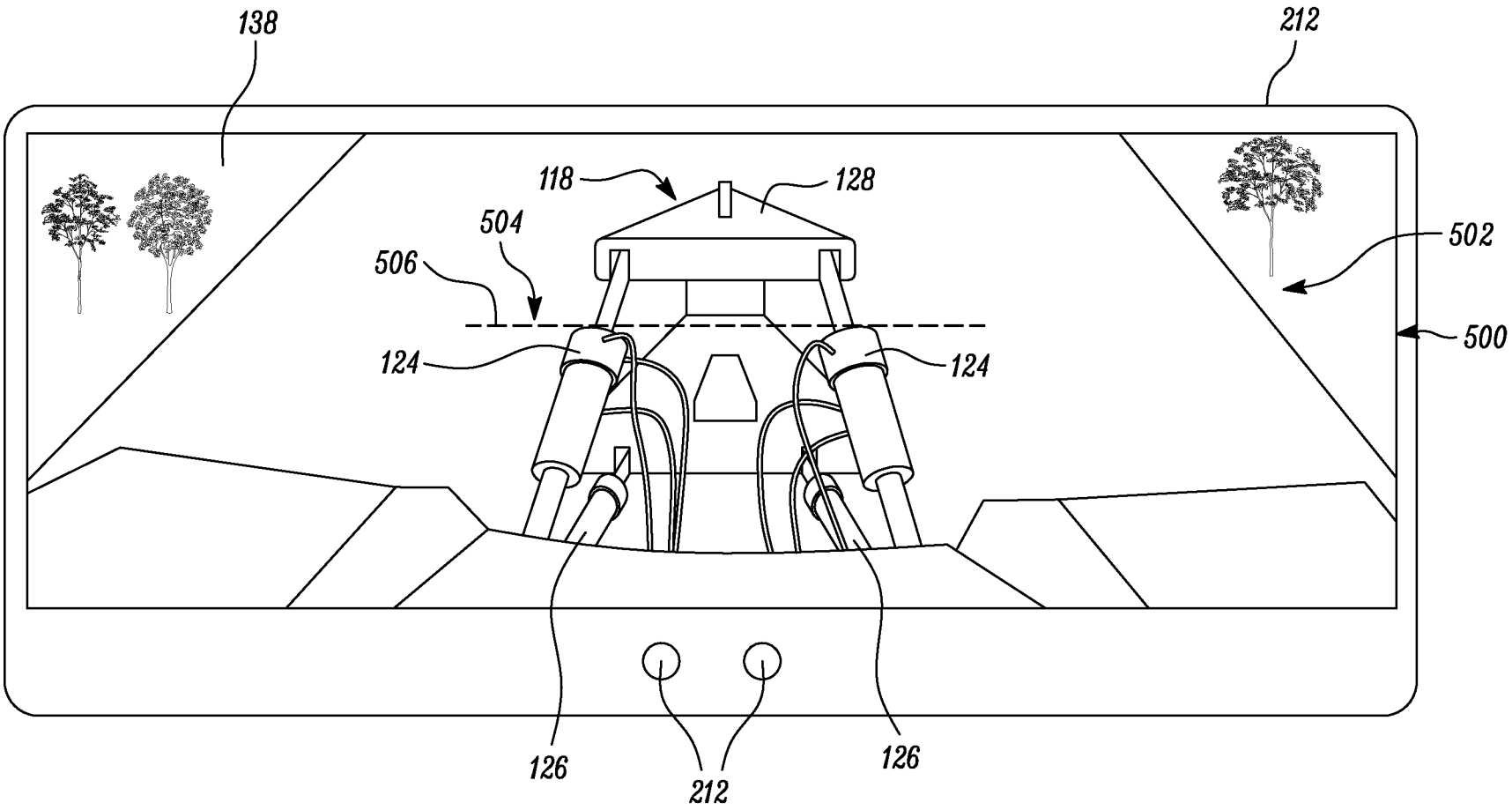
FIG. 5 illustrates an output image generated by a controller of the operator assistance system of FIG. 3, according to an embodiment of the present disclosure.

Referring to FIG. 5, the one or more processors 208 (see FIG. 3) generate an output image 500 containing a second pictorial view 502 and an indication element 504 superimposed on the second pictorial view 502. The second pictorial view 502 is at least in part derived from the first pictorial view 402 (see FIG. 4) and includes the work implement 118. In the illustrated embodiment of FIG. 5, the second pictorial view 502 includes the pair of first actuators 124, the second actuators 126, and the carriage 128 of the work implement 118. However, in other examples, the second pictorial view 502 may also include the ground engaging element 130, the pair of second actuators 126, or any other portion of the work implement 118, based on application requirements.

It should be noted that the indication element 504 may be superimposed on the second pictorial view 502 such that the features of the work implement 118 are visible in the second pictorial view 502. Thus, the indication element 504 may not compromise a visual access to the different components of the work implement 118. The indication element 504 includes one or more reference lines 506. In the illustrated embodiment of FIG. 5, the indication element 504 includes the single reference line 506. Further, an alignment of one or more portions of the work implement 118 with the reference line 506 indicates that the one or more portions of the work implement 118 are positioned at a desired height "H1" (see FIGS. 1 and 2) from the ground surface 138. In the illustrated embodiment of FIG. 5, the one or more portions of the work implement 118 includes the pair of first actuators 124 of the work implement 118. In other words, the reference line 506 is in alignment with a frontmost section of each of the pair of first actuators 124. Alternatively, the one or more portions may include the pair of second actuators 126, the carriage 128, and/or the ground engaging element 130, without any limitations.

Further, in some examples, the reference line 506 may indicate that the work implement 118 is disposed at the desired height "H1" in relation to a ground engaging surface of the work machine 100. For example, the ground engaging surface may be associated with the ground engaging member 112 (see FIGS. 1 and 2) or the ground engaging element 130 (see FIGS. 1 and 2). It should be noted that the desired height "H1" may vary based on the portion of the work implement 118 that is to be aligned with the indication element 504. For example, the desired height "H1" may include a height defined between the first actuators 124 and the ground surface 138. Alternatively, the desired height "H1" may include a height defined between a topmost section of the carriage 128 and the ground surface 138. Further, the desired height "H1" may vary based on a current position of the work implement 118. For example, the desired height "H1" as depicted in FIG. 1 is greater than the desired height "H1" as depicted in FIG. 2 as the work implement 118 is in engagement with the ground surface 138 in FIG. 2.

In some examples, the processors 208 of the controller 204 (see FIG. 3) may receive, analyze, and process the input image 400 (see FIG. 4) to generate the output image 500. For example, the processor 208 may analyze the input image 400 to determine a position of the pair of first actuators 124 in the first pictorial view 402. Further, in an example, the processors 208 may retrieve a program or a software from the one or more memories 206 to superimpose the reference line 506 based on a determination of the position of the pair of first actuators 124 in the first pictorial view 402, such that the reference line 506 is in alignment with the pair of first actuators 124.

In the illustrated embodiment of FIG. 5, the reference line 506 is illustrated as a dotted line. Alternatively, the reference line 506 may include a solid line. In some examples, the reference line 506 may be color coded so that the reference line 506 may be easily identified on the output image 500. For example, the reference line 506 may be red in color or the reference line 506 may be black in color. In an example, the reference line 506 may be rectangular in shape and may further include a hatching and/or a color coding. It should be noted that a shape and a size of the reference line 506 may vary, without any limitations. It should be noted that the output image 500 may include still images or videos. For example, the input and output images 400, 500 in a video format may assist the operator in positioning the one or more portions of the work implement 118 at the desired height "H1".

In some embodiments, the one or more processors 208 further receive an input signal "I1" (see FIG. 3) from the operator for adjusting a position of the indication element 504 based on the desired height "H1". More particularly, the input signal "I1" may be indicative of the desired height "H1". In some examples, the operator may provide the input signal "I1" before initiating the work operation so that the one or more portions of the work implement 118 can be accurately positioned at the desired height "H1". The operator may provide the input signal "I1" to a user interface 210 associated with the work machine 100 or any other input device present within the operator cabin 108 (see FIGS. 1 and 2). The indication element 504 may be adjusted based on operator expertise, by using a trial and error method, and the like. Alternatively, the indication element 504 may be adjusted based on inputs received from one or more sensor devices.

Further, the one or more processors 208 transmit the output image 500 to the user interface 210. Specifically, the operator assistance system 200 includes the user interface 210 that receives the output image 500 from the one or more processors 208. Further, the user interface 210 displays the output image 500 thereon to assist the operator in positioning the one or more portions of the work implement 118 at the desired height "H1".

In some examples, the user interface 210 may display the output image 500 based on an operating mode of the work implement 118. For example, the user interface 210 may automatically display the output image 500 if the work implement 118 is in an operational mode. In an example, the output image 500 may be transmitted to the user interface 210 based on a position of the operating device 136 (see FIG. 3). For example, if the operating device 136 indicates that the work implement 118 is in the operational state, the output image 500 may be displayed on the user interface 210. In some examples, the output image 500 may be displayed on the user interface 210 until the work implement 118 is in the operational state.

Further, if the work implement 118 is in a stationery or non-operational mode, the user interface 210 may not display the output image 500. In such examples, the user interface 210 may only display the input image 400 that is received from the imaging device 202. In some examples, if the operating device 136 indicates that the work implement 118 is in the non-operational state, the output image 500 may not be displayed on the user interface 210. In another example, the user interface 210 may display the output image 500 based on an operator input "I2" (see FIG. 3) received from the operator. For example, the operator may provide the operator input "I2" to the controller 204 using the user interface 210 or another input device in the operator cabin 108. Based on the operator input "I2", the controller 204 may transmit the output image 500 to the user interface 210.

Moreover, the output image 500 may be displayed on the user interface 210 when the work implement 118 is engaged with the ground surface 138 or disengaged from the ground surface 138. For example, the output image 500 may be displayed before initiation of the work operation when the work implement 118 is disengaged from the ground surface 138 (as shown in FIG. 1) so that the work implement 118 can be positioned at the desired height "H1". In another example, the user interface 210 may display the output image 500 when the work implement 118 is engaged with the ground surface 138 (as shown in FIG. 1). In such an example, the output image 500 may allow the operator to verify if the work implement 118 is disposed at the desired height "H1" while the work operation is being performed.

In an example, the controller 204 may be an integral component of the user interface 210. In another example, the controller 204 and the user interface 210 may be embodied as separate components. The user interface 210 may include an electroluminescent (ELD) display, a liquid crystal display (LCD), a light-emitting diode (LED) display, a thin-film transistor (TFT), and the like. Further, the user interface 210 may include a portable handheld device, such as, a mobile phone, a tablet, and the like. The user interface 210 may embody a touch screen. In such an example, the user interface 210 may present various control icons on the touch screen for operator assistance. Alternatively, the user interface 210 may include one or more physical input devices 212. The input devices 212 are embodied as buttons herein. Alternatively, each input device 212 may include a switch, a button, a lever, a knob, and the like, without any limitations. In an example, the operator may use one of the input devices 212 present on the user interface 210 to provide the input signal "I1" and/or the operator input "I2". It may also be contemplated that the user interface 210 may embody a heads-up display unit, without any limitations. Further, the user interface 210 may be positioned within the operator cabin 108. It should be noted that the user interface 210 only displays the output image 500 in FIG. 5. However, in other applications, the user interface 210 may also display other information or notifications, such as, a speed of the work machine 100, a fuel, level, etc.

Further, the control icons and/or the input devices 212 on the user interface 210 may also allow the operator to customize the indication element 504. For example, the control icons and/or the input devices 212 may allow the operator to change a thickness of the reference line 506 or a color of the reference line 506. The control icons and/or the input devices 212 may also allow the operator to zoom in or zoom out to examine the output image 500.

In an example, the controller 204 may also generate an alert if the one or more portions of the work implement 118 is misaligned with respect to the reference line 506, during the work operation is being performed. In such examples, the operator may control the operating device 136 to adjust the work implement 118 so that the one or more portions of the work implement 118 is in alignment with the reference line 506. The alert may be an audio alert (such as, a buzzer, a voice message, etc.) or a visual alert (such as, a text message, an icon, etc.) provided by the user interface 210. In some example, the output image 500 may also include one or more graphics that may assist the operator in aligning the one or more portions of the work implement 118 with the reference line 506. For example, the output image 500 may include arrows depicting a direction in which the work implement 118 should be moved so that the work implement 118 is disposed at the desired height "H1".

Figure 6:
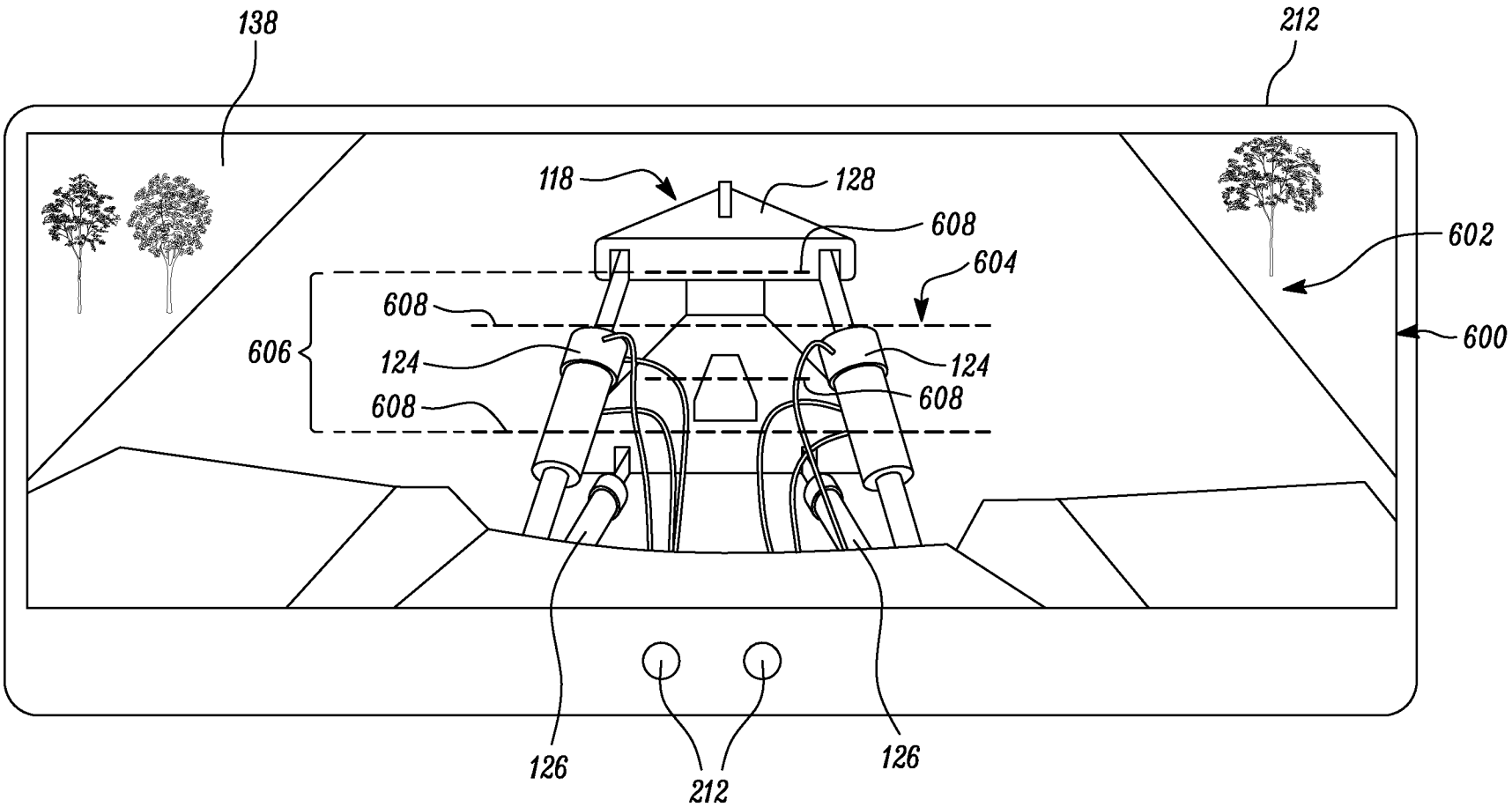
FIG. 6 illustrates an output image generated by the controller of the operator assistance system of FIG. 3, according to another embodiment of the present disclosure.

Referring now to FIG. 6, an exemplary output image 600 as displayed on the user interface 210 is illustrated. The output image 600 contains a second pictorial view 602 and an indication element 604. The second pictorial view 602 and the indication element 604 are substantially similar to the second pictorial view 502 (see FIG. 5) and the indication element 504 (see FIG. 5), respectively, in terms of functionality. The indication element 604 includes a reference zone 606. The reference zone 606 includes a number of reference lines 608. The alignment of the one or more portions of the work implement 118 with one of the number of reference lines 608 indicates that the one or more portions of the work implement 118 are positioned at the desired height "H1" (see FIGS. 1 and 2) from the ground surface 138. In some examples, a positioning of the one or more portions of the work implement 118 within the reference zone 606 may indicate that the one or more portions of the work implement 118 are positioned at the desired height "H1".

It should be noted that the alignment of the work implement 118 with each reference line 608 may position the work implement 118 at a different desired height "H1". Accordingly, the one or more portions of the work implement 118 may be aligned with each reference line 608 to position the work implement 118 at different desired heights "H1", based on application requirements. For example, if a value of the desired height "H1" is high, the one or more portions of the work implement may be aligned with the topmost reference line 608 of the reference zone 606. Moreover, if the value of the desired height "H1" is low, the one or more portions of the work implement may be aligned with the bottommost reference line 608 of the reference zone 606.

In the illustrated embodiment of FIG. 6, the reference zone 606 includes four reference lines 608. However, the reference zone 606 may include any number of reference lines 608, based on the application requirements. In the illustrated embodiment of FIG. 6, each reference line 608 is illustrated as a dotted line. Alternatively, the reference lines 608 may include a solid line. In some examples, the reference lines 608 may be color coded so that the reference lines 608 may be easily identified on the output image 600. For example, the reference lines 608 may be red in color or the reference lines 608 may be black in color. In an example, the reference lines 608 may be rectangular in shape and may further include a hatching and/or a color coding. It should be noted that a shape and a size of the reference lines 608 may vary, without any limitations.

INDUSTRIAL APPLICABILITY

The present disclosure relates to the operator assistance system 200 associated with the work machine 100 and a method 700 of assisting the operator of the work machine 100. The operator assistance system 200 and the method 700 may assist the operator in positioning the work implement 118 at the desired height "H1". Specifically, the operator assistance system 200 and the method 700 may allow the operator to align one or more portions (for e.g., the first actuators 124, the carriage 128, or the second actuators 126) of the work implement 118 with the reference lines 506, 608, so that the work implement 118 can be positioned at the desired height "H1". An accurate positioning of the work implement 118 may ensure that the work operation is performed in an optimum manner, thereby improving a productivity of the work operation. Further, the operator assistance system 200 may improve a confidence of the operator and may also reduce a scope of errors while performing the work operation. Furthermore, the operator assistance system 200 may prevent a possibility of wear of the work implement 118 due to an unintentional lowering of the work implement 118 into the ground surface 138.

The controller 204 of the operator assistance system 200 generates the output image 500, 600 including the indication elements 504, 604, respectively. The indication elements 504, 604 include the reference lines 506, 608, respectively, that may allow the operator to adjust the position of the work implement 118. Moreover, the reference lines 506, 608 of the indication elements 504, 604, respectively, are highlighted in a manner such that the reference lines 506, 608 can be easily identified by the operator. In some examples, the output image 500, 600 may also allow a real-time monitoring of the alignment between the one or more portions of the work implement 118 and the reference lines 506, 608 while the work operation is being performed, thereby providing an indication that the work implement 118 is positioned at the desired height "H1" at all instances during the work operation.

Further, the controller 204 of the operator assistance system 200 generates the output image 600 including the reference zone 606. In some examples, a presence or absence of the one or more portions of the work implement 118 within the reference zone 606 may inform the operator whether the work implement 118 is disposed at the desired height "H1". The number of reference lines 608 may also be helpful when the work operation demands removal of materials from different depths below the ground surface 138. More particularly, the reference lines 608 may allow positioning of the work implement 118 at different desired heights "H1", based on application requirements. Further, the operator assistance system 200 including the imaging device 202, the controller 204, and the user interface 210 may form a kit that can be retrofitted on existing work machines during a servicing schedule with minimum modifications. Moreover, the operator assistance system 200 may be cost-effective to incorporate in various work machines.

Figure 7:
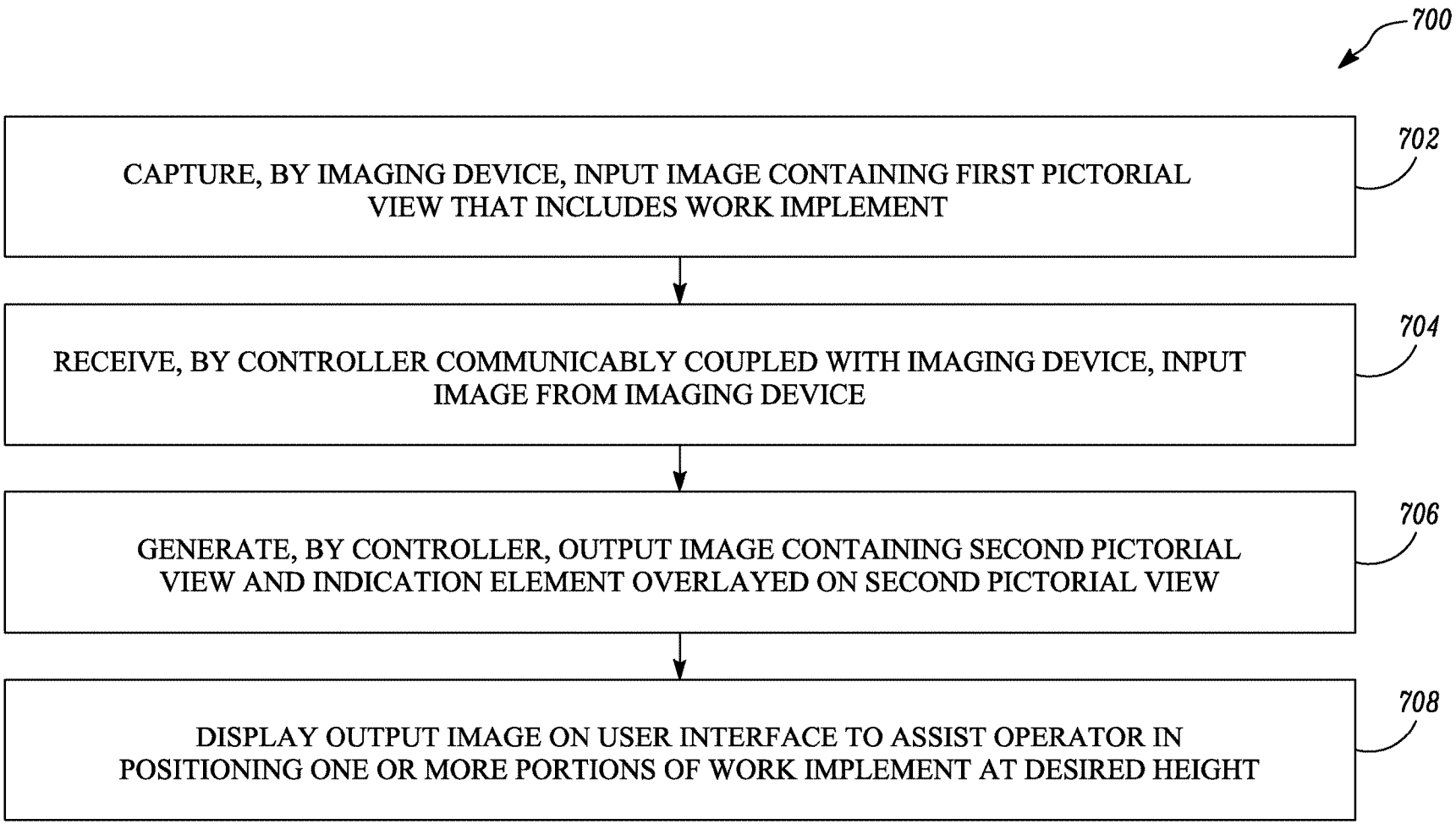
FIG. 7 illustrates a flowchart for a method of assisting an operator of the work machine, according to an embodiment of the present disclosure.

Referring to FIG. 7, a flowchart for the method 700 of assisting the operator of the work machine 100 is illustrated. The method 700 will now be explained in relation to FIGS. 3, 4, and 5. However, the method 700 is equally applicable to the embodiment illustrated on FIG. 6. At step 702, the imaging device 202 mounted on the work machine 100 and facing the work implement 118 of the work machine 100 captures the input image 400 containing the first pictorial view 402 that includes the work implement 118. The work implement 118 may include the ripper.

At step 704, the controller 204 communicably coupled with the imaging device 202 receives the input image 400 from the imaging device 202. At step 706, the controller 204 generates the output image 500 containing the second pictorial view 502 and the indication element 504 superimposed on the second pictorial view 502. The second pictorial view 502 is at least in part derived from the first pictorial view 402 and includes the work implement 118. Further, the indication element 504 includes the one or more reference lines 506. Furthermore, the alignment of the one or more portions of the work implement 118 with the one or more reference lines 506 indicates that the one or more portions of the work implement 118 are positioned at the desired height "H1" from the ground surface 138.

At step 708, the user interface 210 displays the output image 500 to assist the operator in positioning the one or more portions of the work implement 118 at the desired height "H1". The user interface 210 receives the output image 500 from the controller 204. The user interface 210 may display the output image 500 based on the operating mode of the work implement 118. In some examples, the user interface 210 may display the output image 500 when the work implement 118 is engaged with the ground surface 138 or disengaged from the ground surface 138. Further, the controller 204 may also receive the input signal "I1" for adjusting the position of the indication element 504 based on the desired height "H1".

Referring now to FIGS. 6 and 7, in some examples, the indication element 604 may include the reference zone 606. The reference zone 606 includes the number of reference lines 608. Further, the alignment of the one or more portions of the work implement 118 with one or more of the number of reference lines 608 indicates that the one or more portions of the work implement 118 are positioned at the desired height "H1" from the ground surface 138.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A controller comprising:

one or more memories; and one or more processors configured to:

receive an input image, wherein the input image contains a first pictorial view that includes a first portion of a work implement of a work machine; and generate an output image containing a second pictorial view and an indication element superimposed on the second pictorial view, wherein the second pictorial view is at least in part derived from the first pictorial view and includes the first portion of the work implement, wherein the indication element includes at least one reference line, and wherein an alignment of the first portion of the work implement with the at least one reference line indicates that a second portion of the work implement that is not contained within either a boundary of the first pictorial view or a boundary of the second pictorial view is positioned at a desired height from a ground surface to perform work outside of the boundary of the first pictorial view and the boundary of the second pictorial view.

2. The controller of claim 1, wherein the one or more processors are further configured to receive the input image from an imaging device, the imaging device being mounted on the work machine and facing the work implement of the work machine, the imaging device being configured to capture the input image containing the first pictorial view that includes the work implement.

3. The controller of claim 1, wherein the one or more processors are further configured to transmit the output image to a user interface, and wherein the user interface is configured to display the output image thereon to assist an operator in positioning the second portion of the work implement at the desired height.

4. The controller of claim 3, wherein the user interface is configured to display the output image based on an operating mode of the work implement.

5. The controller of claim 3, wherein the output image is displayed on the user interface when the work implement is engaged with the ground surface or disengaged from the ground surface.

6. The controller of claim 3, wherein the one or more processors are further configured to receive an input signal from an operator for adjusting a position of the indication element based on the desired height.

7. The controller of claim 1, wherein the indication element includes a reference zone, wherein the reference zone includes a plurality of reference lines, and wherein an alignment of the first portion of the work implement with at least one of the plurality of reference lines indicates that the second portion of the work implement is positioned at the desired height from the ground surface.

8. The controller of claim 1, wherein the alignment comprises superimposing the at least one reference line over the first portion of the work implement in the second pictorial view.

9. An operator assistance system associated with a work machine, the operator assistance system comprising:

an imaging device mounted on the work machine and facing a work implement of the work machine, the imaging device being configured to capture an input image containing a first pictorial view that includes a first portion of the work implement;

a controller communicably coupled with the imaging device, the controller including one or more processors configured to:

receive the input image from the imaging device; and generate an output image containing a second pictorial view and an indication element superimposed on the second pictorial view, wherein the second pictorial view is at least in part derived from the first pictorial view and includes the first portion of the work implement, wherein the indication element includes at least one reference line, and wherein an alignment of the first portion of the work implement with the at least one reference line indicates that a second portion of the work implement which is not visible in the second pictorial view and which is outside of an area of the second pictorial view is positioned at a desired height from a ground surface, the desired height being outside of the second pictorial view; and a user interface configured to receive the output image from the one or more processors, wherein the user interface is configured to display the output image thereon to assist an operator in positioning the second portion of the work implement at the desired height.

10. The operator assistance system of claim 9, wherein the indication element includes a reference zone, wherein the reference zone includes a plurality of reference lines, and wherein an alignment of the first portion of the work implement with at least one of the plurality of reference lines indicates that the second portion of the work implement is positioned at the desired height from the ground surface.

11. The operator assistance system of claim 9, wherein the one or more processors are further configured to receive an input signal from the operator for adjusting a position of the indication element based on the desired height.

12. The operator assistance system of claim 9, wherein the user interface is configured to display the output image based on an operating mode of the work implement.

13. The operator assistance system of claim 9, wherein the output image is displayed on the user interface when the second portion of the work implement is engaged with the ground surface or disengaged from the ground surface.

14. The operator assistance system of claim 9, wherein the second portion of the work implement is a ripper.

15. A method of assisting an operator of a work machine, the method comprising:

capturing, by an imaging device mounted on the work machine and facing a work implement of the work machine, an input image containing a first pictorial view that includes a portion of the work implement;

receiving, by a controller communicably coupled with the imaging device, the input image from the imaging device;

generating, by the controller, an output image containing a second pictorial view and an indication element superimposed on the second pictorial view, wherein the second pictorial view is at least in part derived from the first pictorial view and includes the portion of the work implement, wherein the indication element includes at least one reference line, and wherein an alignment of the portion of the work implement with the at least one reference line indicates that another portion of the work implement, which is not visible in either the first or second pictorial view because the another portion of the work implement is blocked from view by the portion of the work implement, and which is configured to engage a ground surface, is positioned at a desired height from a ground surface; and displaying the output image on a user interface to assist the operator in positioning the another portion of the work implement at the desired height, wherein the user interface is configured to receive the output image from the controller, and wherein the output image does not display the another portion of the work implement.

16. The method of claim 15, wherein the indication element includes a reference zone, wherein the reference zone includes a plurality of reference lines, and wherein an alignment of the portion of the work implement with at least one of the plurality of reference lines indicates that the another portion of the work implement is positioned at the desired height from the ground surface.

17. The method of claim 15 further comprising receiving, by the controller, an input signal for adjusting a position of the indication element based on the desired height.

18. The method of claim 15 further comprising displaying the output image based on an operating mode of the portion of the work implement or the another portion of the work implement.

19. The method of claim 15 further comprising displaying the output image on the user interface when the another portion of the work implement is engaged with the ground surface or disengaged from the ground surface.

20. The method of claim 15, wherein the another portion of the work implement is a ripper.

* * * * *